United States Patent [19]

Bakker et al.

[11] 4,398,324

[45] Aug. 16, 1983

[54] CENTER RELEASE BUCKLE

[75] Inventors: John A. Bakker, Bartlett, Ill.; Edward C. French, Fullerton, Calif.

[73] Assignee: Illinois Tool Works Inc., Chicago, Ill.

[21] Appl. No.: 244,429

[22] Filed: Mar. 16, 1981

[51] Int. Cl.[3] ..... B65D 63/00

[52] U.S. Cl. ..... 24/230 R

[58] Field of Search ..... 24/230 R, 216, 217

[56] References Cited

U.S. PATENT DOCUMENTS

| | | | |
|---|---|---|---|
| 1,701,970 | 2/1929 | Chaunard | 24/230 |
| 3,251,110 | 5/1966 | Hedu | 24/230 |
| 3,399,431 | 9/1968 | Shanklin et al. | 40/230 R |
| 3,514,816 | 3/1969 | Inoue | 24/77 |
| 3,798,711 | 6/1972 | Counsins | 24/77 R |
| 3,844,000 | 10/1974 | Hedu | 24/230 |
| 4,001,532 | 1/1977 | Kubota et al. | 24/230 A |
| 4,035,877 | 9/1975 | Brownson | 24/430 |
| 4,171,555 | 10/1979 | Baaker | 24/200 |

FOREIGN PATENT DOCUMENTS

| | | | |
|---|---|---|---|
| 2637075 | 8/1976 | Fed. Rep. of Germany | 24/230 |
| 306441 | 11/1968 | Sweden | 24/230 SC |

*Primary Examiner*—Robert A. Hafer

*Assistant Examiner*—Wenceslao J. Contreras

*Attorney, Agent, or Firm*—Jerold M. Forsberg; Thomas W. Buchman

[57] ABSTRACT

A molded plastic buckle adapted to releasably secure extremities of a web-like material includes a receptacle body and an insert body having a tongue portion adapted to be slidably received in the receptacle body. The receptacle body includes a top wall having a through aperture defining a plurality of surrounding side surfaces. At least one of these side surfaces is angled to converge in the direction of slidable insertion of the insert body tongue portion. The insert body tongue portion includes a raised portion receivable within the aperture. This raised portion has a trailing side surface formed at a complementary angle to the angled side surface of the aperture to facilitate locking interengagement between the raised portion and the aperture. A resilient, deflectable bottom wall of the receptacle body deflects in response to slidable insertion of the tongue portion therein, and thereafter urges the tongue portion upwardly to facilitate locking interengagement between the raised portion thereof and the aperture in the receptacle body top wall.

11 Claims, 7 Drawing Figures

CENTER RELEASE BUCKLE

BACKGROUND OF THE INVENTION

The present invention is directed generally to the buckle art and more particularly to a two-piece, molded plastic buckle structure.

Two-piece buckle structures are generally known in the art, and have often been referred to heretofore by terms such as clasp, clasp fastener, and the like. To facilitate the present disclosure, however, the term buckle will be generally utilized hereinafter to refer to the invention.

For example in U.S. Pat. No. 1,701,970 to Chaunard, a two-piece clasp structure is revealed, perferably constructed from metal for use with jewelry or the like. Similarly, in related U.S. Pat. Nos. 3,251,110 and 3,844,000 to Hedu, fastener devices consisting of a separable housing member and insert member are illustrated. These latter fastener devices are suitable for uses in garments, jewelry and the like for detachably holding two articles together. Moreover, these latter fasteners are preferably made of plastics material by conventional injection molding techniques.

In each of the foregoing prior art devices, some form of releasable locking means are provided on one or both of the interfitting housing member and insert member to effect releasable coupling of the fastener or buckle device. However, especially in molded plastics products, there is some difficulty with providing positively interlocking devices which are sufficiently resistant to inadvertent disengagement.

In this latter regard, it is desirable to provide an interlocking structure or arrangement which while quite simple to engage, preferably in response to a single direction of movement by the user, requires a more complex movement for disengagement. Moreover, it is desirable to provide such a structure which may be readily molded by conventional techniques at a minimum of labor and expense. In this latter regard, minimizing the labor and expense of producing such a molded part requires that the design thereof be relatively simple and require as few independent and/or moving parts as possible.

OBJECTS AND SUMMARY OF THE INVENTION

Accordingly, it is a general object of this invention to provide a novel and improved buckle.

A more specific object is to provide such a buckle which includes cooperatively acting resilient means and interlocking means, requiring but a single motion by the user for locking engagement thereof.

A related object is to provide a buckle in accordance with the foregoing objects which further requires a more complex motion of actuation by the user to effect disengagement thereof, once engaged into its locking position.

Yet another object is to provide a buckle in accordance with the foregoing objects which is relatively simple and inexpensive to produce by conventional injection molding techniques.

Briefly, and in accordance with the foregoing objects, a buckle in accordance with the present invention comprises a receptacle body and an insert body including a tongue portion adapted to be slidably received in the receptacle body. The receptacle body further includes a top wall portion having a through aperture defining a plurality of surrounding side surfaces, at least one of these side surfaces being formed at an angle which converges in the direction of slidable insertion of the insert body. The insert body tongue portion further includes at least one raised portion receivable within the aperture. This raised portion defines at least one side surface formed at a complementary angle to the above mentioned angled side surface defined by the aperture to facilitate locking interengagement between the raised portion and the aperture. Resiliently deflectable means is provided in the receptacle body portion for deflecting in response to slidable insertion of the tongue portion therein, and thereafter urging the tongue portion upwardly to facilitate locking interengagement between the raised portion thereof and the aperture in the receptacle body.

The foregoing, as well as other objects, features and advantages of the invention will be more readily appreciated upon reading the following detailed description of the illustrated embodiment, and referring to the accompanying drawings, wherein:

DETAILED DESCRIPTION OF THE ILLUSTRATED EMBODIMENT

Figure 1:
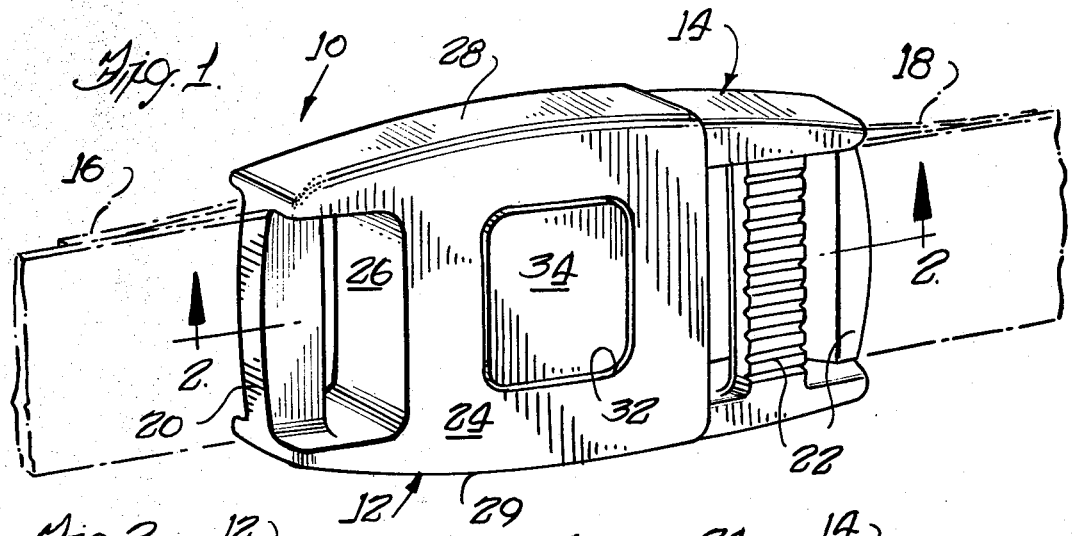
FIG. 1 is a perspective view of a buckle in accordance with the present invention, in an engaged condition.
Figure 2:
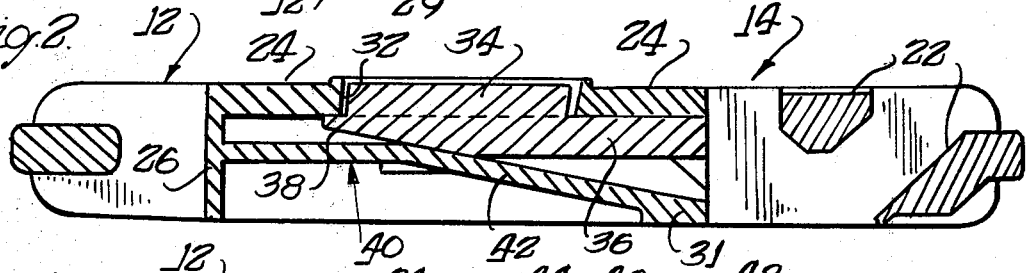
FIG. 2 is a sectional view taken generally along the line 2—2 of FIG. 1.

Referring now to the drawings and initially to FIG. 1 there is seen a buckle in accordance with the present invention, designated generally by the reference numeral 10. In FIG. 1 and in FIG. 2, the buckle is illustrated in its engaged condition, for example, for joining the ends of two web-like members 16, 18. In this regard, the buckle 10 includes a receptacle member or body 12 which slidably, lockingly engages an insert member or body 14. Accordingly, the respective web-like members 16, 18 are carried on suitable web engaging means 20, 22 provided on the respective buckle members 12, 14.

These web-engaging means 20, 22 preferably include bars transversely mounted at respective outer ends of the buckle members or bodies 12, 14. These bars 20, 22 are substantially of the type shown and described in U.S. Pat. No. 4,171,555, and form no part of the present invention.

Figure 3:
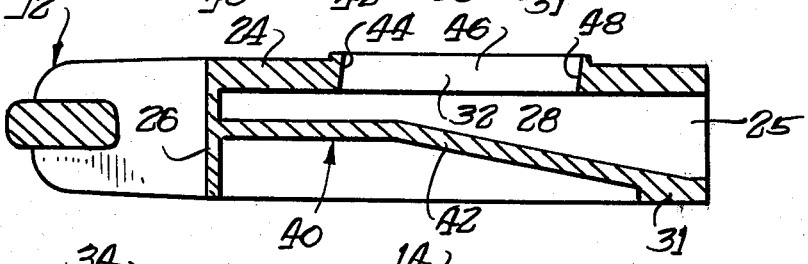
FIG. 3 is a sectional view, similar to FIG. 2, of one component of the buckle illustrated in FIG. 1 and FIG. 2.

Referring now also to FIG. 3, it will be seen that the receptacle member 12 has a substantially open or hollow interior portion defined by an apertured top wall 24, a pair of opposed side walls 28, 29 and a back wall 26. An end opening 25 opposite the back wall 26 is defined by the top wall 24, the side walls 28, 29 and a transverse bar 31 extending between the side walls 28, 29.

Figure 4:
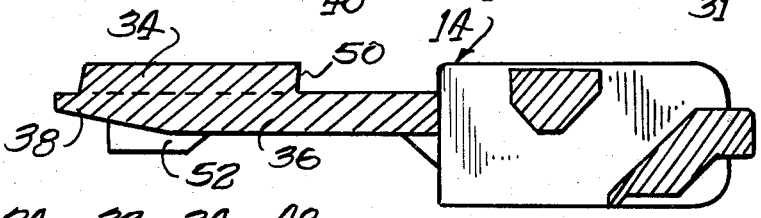
FIG. 4 is a sectional view, similar to FIG. 2 of a second component of the buckle structure illustrated in FIGS. 1 and 2.

In accordance with a feature of the invention, the apertured top wall 24 includes a through aperture 32 which releasably locks with a complementary raised area 34 of the insert member 14. As best viewed in FIG. 4, this raised area 34 is carried on a tongue portion 36 of the insert member 14 which is slidably received within the receptacle member 12 to achieve fastening of the buckle 10. This tongue portion 36 further includes a leading ramp surface 38 which converges to a leading edge 39.

In accordance with a further feature of the invention, receptable member 12 includes a flexible, resiliently deflectable wall member 40 which extends between transverse bar 31 and a mid-portion of the back wall 26. Advantageously, this flexible wall member 40 includes a ramp portion 42 which converges from the opening 25 inwardly of the receptacle member 10 to form a complementary surface for receiving the leading ramp 38 of the tongue 36.

As best viewed in FIG. 3, the aperture 32 of the receptacle member 12 is defined by a plurality of walls or surfaces 44, 46, 48 which extend through the top wall 24 to the hollow interior of the receptacle body 12. In the illustrated embodiment these surfaces 44, 46, 48 are four in number, being adjacently joined by generally rounded corners or edges, as best viewed in FIG. 1. Cooperatively, the raised portion or area 34 of the tongue member 36 generally conforms to the configuration of the aperture 32 for interfitting therewith.

More importantly in this regard, and in accordance with a further feature of the invention, it will be seen that the wall or surface 48 is formed at an angle which generally converges inwardly or in the direction of insertion of the tongue member 36. Cooperatively, a rear or trailing side wall portion 50 of the raised area or portion 34 is formed at a complementary angle so as to lockingly engage with the surface or wall 48. In this way, the engagement between these two walls or surfaces 48, 50 discourages disengagement of the two bodies 12, 14 upon engagement of the raised area or portion 34 with the aperture 32.

Figure 5:
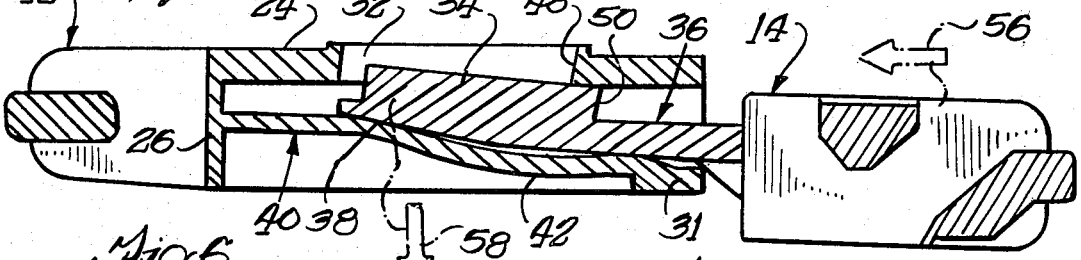
FIG. 5 is a sectional view, similar to FIG. 2, showing the buckle in a partially disengaged condition.

Referring now to FIG. 5, the two bodies 12, 14 are shown in an intermediate position, midway between engagement and disengagement therebetween. In this position, a further feature of the invention will become apparent. Namely, the flexible, resiliently deflectable wall member 40 becomes partially deflected upon slidable insertion thereover of the tongue portion 36. Thus, the leading edge of the raised portion 34 is urged by the resiliently deflectable wall 40 partially into the aperture 32, while the trailing portion thereof is held beneath the top wall 24. Hence, a generally rocking, sliding motion of the insert member or body 14 occurs upon movement thereof in the direction of insertion indicated by the arrow 56. Advantageously, the interengagement of the bodies 12, 14 is therefore relatively simple. Moreover, the motion of the insert body 14 in the direction 56 generally causes elastic deflection of the resiliently deflectable wall 40 in the direction indicated generally by the arrow 58. Accordingly, upon insertion of the tongue portion 36 sufficiently to align the raised area portion 34 with the aperture 32, engagement therebetween occurs due to the elastic return of the flexible or resiliently deflectable wall member 40 to its original, undeflected position, as illustrated in FIG. 3.

Similarly, to effect disengagement of the bodies 12, 14, it will be noted that a generally downward and slightly forward motion, i.e., in the direction 56, of the raised member 34 will cause slidable disengagement thereof from the aperture 32. In particular this compound motion permits slidable disengagement of the complementary angled walls 48, 50. The downward component of this motion will also result in elastic deflection of the resiliently deflectable wall member 40. Due to the ensuing interengagement of the cooperating ramp portions 38 and 42, and the resiliency of the wall member 40, the tongue 36 and hence the insert member 14 will be urged outwardly of the receptacle member 12, from the position illustrated in FIG. 5.

Figure 6:
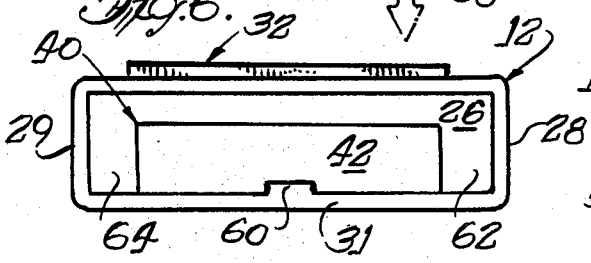
FIG. 6 is an end view of one component of the buckle of FIG. 1.
Figure 7:
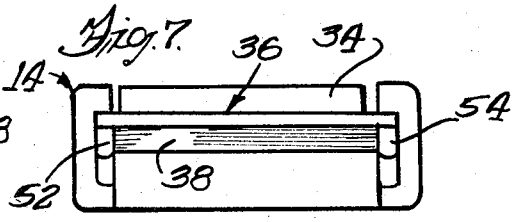
FIG. 7 is an end view of the second component of the buckle of FIG. 1.

Referring now also to FIG. 6 and FIG. 7, end views of the receptacle body 12 and insert body 14 illustrate further features thereof. In particular, it will be noted that the tongue portion 36 further includes a pair of downwardly depending legs or tab members at the lateral side edges thereof. Cooperatively, the receptacle body 12 has a pair of channels 62, 64 defined between the respective side walls 28, 29 and the lateral side edges of the resiliently deflectable wall member 40. Hence, generally horizontal or side-to-side alignment between the tongue 36 and the receptacle body 12 is encouraged. Additionally, the transverse bar member 31 at the open end 25 of the receptacle body 12 includes a centered, raised abutment 60 which abuts the tongue portion 36 and particularly the leading ramp portion 38 thereof upon initial insertion to encourage vertical or top-to-bottom alignment therebetween.

Advantageously, the tongue portion 36, together with the raised area or portion 24 thereof, the ramp 38 and the alignment tabs or legs 52, 54, may be integrally formed, as by molding, from a suitable plastics material. Similarly, the receptacle body 12, including the aperture 32 and the resiliently deflectable wall member 40 thereof may likewise be integrally formed, as by molding, from suitable plastics material.

What has been shown and described herein is a novel and improved buckle for releasably securing extremities of web-like material. Various changes, alternatives and modifications may occur to those skilled in the art upon reading the foregoing descriptions. Accordingly, such changes, alternatives and modifications are to be considered as forming a part of the present invention, insofar as they fall within the spirit and scope of the appended claims.

The invention is claimed as follows:

1. A buckle adapted to releasably secure extremities of a web-like material and comprising a receptacle body having a pair of oppositely facing side walls, an end wall and an end opening opposite said end wall, said side walls, end wall and end opening collectively defining a hollow interior, an insert body including a tongue portion adapted to slidably interfit through said end opening and within said hollow interior, said receptacle body further including a top wall having an aperture therein and a resiliently deflectable member disposed opposite and facing said top wall and extending between said end wall and said end opening, said resiliently deflectable member extending into said hollow interior and said resiliently deflectable member including a ramp surface converging inwardly of said hollow interior from a point adjacent said end opening of the receptacle body and upwardly towards the top wall to a point generally facing an intermediate point in said aperture defined in said top wall, said resiliently deflectable member integrally molded as a portion of said receptacle body and said insert body tongue portion comprising an integrally molded plastic part, said insert body tongue portion further including a raised portion for inter-engagement with said aperture in said top wall, said resiliently deflectable member initially deflecting in response to slidable insertion of said tongue portion into said hollow interior and thereafter resiliently urging said raised portion into at least partial telescopic association and inter-engagement with said aperture in said top wall for discouraging disengagement of said receptacle body from said insert body, said receptacle body and said insert body further being respectively provided with means for receiving said extremities of said web-like material.

2. A buckle according to claim 1 wherein said top wall includes a through aperture defined by a plurality of surfaces extending generally outwardly of said hollow interior of said receptacle body, at least one of said plurality of surfaces comprising an angled surface converging from said hollow interior inwardly toward the center of said aperture and substantially in the direction of insertion of said insert body tongue portion with respect to said receptacle body and wherein said raised portion is of like dimensions to said aperture and includes at least one complementary angled side surface of locking engagement with said at least one angled surface of said plurality of surfaces.

3. A buckle according to claim 1 and further including a complementary ramp surface at a leading end of said tongue portion for slidably engaging with said ramp surface of said resiliently deflectable member during insertion of said tongue portion into said hollow interior and to facilitate interengagement thereof with said receptacle body.

4. A buckle according to claim 1 or claim 2 and further including outwardly extending leg portions at lateral side edges of said tongue portion, said resiliently deflectable member being spaced apart from said side walls to define guide channels for receiving said outwardly extending leg portions of said tongue portion to facilitate side-to-side alignment for insertion of said tongue portion with respect to said receptacle body.

5. A buckle according to claim 4 wherein said receptacle body further includes raised abutment means extending partially into said end opening to facilitate vertical alignment of said tongue portion with respect to said resiliently deflectable member.

6. A buckle according to claim 3 and further including outwardly extending leg portions at lateral side edges of said tongue portion, said resiliently deflectable member being spaced apart from said side walls to define guide channels for receiving said outwardly extending leg portions of said tongue portion to facilitate side-to-side alignment for insertion of said tongue portion with respect to said receptacle body.

7. A buckle according to claim 3 wherein said receptacle body further includes raised abutment means extending partially into said opening to facilitate top-to-bottom alignment of said tongue portion ramp surface with respect to said resiliently deflectable member ramp surface.

8. A molded plastic buckle adapted to releasably secure extremities of a web-like material and comprising a receptacle body having a hollow interior portion and an end opening communicating with said hollow interior portion, an insert body including a tongue portion adapted to be slidably received in said hollow interior portion through said end opening, said receptacle body further including a top wall portion having a through aperture defining a plurality of surrounding side surfaces, at least one of said side surfaces being formed at a converging angle with respect to the direction said insert body is adapted to be aslidably received, said insert body tongue portion further including at least one raised portion receivable within said aperture, said raised portion defining at least one side surface found at a complementary angle to said at least one side surface having a converging angle defined by said aperture to facilitate locking interengagement between said raised portion and said aperture, and resiliently deflectable means in said hollow interior portion for deflecting in response to slidable insertion of said tongue portion into said hollow interior portion, said resiliently deflected means thereafter urging said tongue portion towards said aperture to facilitate said locking interengagement between said raised portion thereof and said through aperture in said top wall portion of said receptacle body portion.

9. A molded plastics buckle according to claim 8 wherein said resiliently deflectable means comprises a resilient member extending between said end opening and an opposite boundary of said hollow interior portion of said receptacle body and resiliently deflectable in a direction normal to the direction of insertion of said insert body tongue portion.

10. A molded plastics buckle according to claim 9 and further including a ramp portion on said resilient member and a cooperating ramp portion in a leading edge of said tongue portion to facilitate gradual deflection of said resilient member in response to slidable insertion of said tongue portion thereover.

11. A buckle adapted to releasable secure extremities of a web-like material and comprising a receptacle body having a pair of oppositely facing side walls, an end wall and an end opening opposite said end wall, said side walls and end wall and end opening collectively defining a hollow interior portion, an insert body including a tongue portion comprising an integrally molded plastic part having a raised part and adapted to slideably interfit through the end opening and within said hollow interior portion, said receptacle body further including an apertured top wall and resiliently deflectable member including a ramp portion converging inwardly at the hollow interior portion from a point adjacent the end opening of the receptacle body and upwardly toward the apertured top wall to a point generally facing an intermediate point in an aperture defined in said apertured top wall, said tongue portion includes a leading ramp surface diverging from a leading edge thereof generally complimentary with said resiliently deflectable member ramp portion and slideably engageable therewith during insertion of the tongue portion into said receptacle body, whereby said ramp portion and said leading ramp surface guide the raised portion of the tongue portion into a position of inter-engagement with said aperture of said apertured top wall, said resiliently deflectable member resiliently urging said raised portion into locking engagement with said aperture.

* * * * *